US007592965B2

(12) United States Patent
Le Bayon et al.

(10) Patent No.: US 7,592,965 B2
(45) Date of Patent: Sep. 22, 2009

(54) DECOUPLING ARRAYS OF RADIATING ELEMENTS OF AN ANTENNA

(75) Inventors: Armel Le Bayon, Saint-Brevin les Pins (FR); Denis Tuau, Trignac (FR)

(73) Assignee: Alcatel Lucent, Paris (FR)

( * ) Notice: Subject to any disclaimer, the term of this patent is extended or adjusted under 35 U.S.C. 154(b) by 0 days.

(21) Appl. No.: 11/872,131

(22) Filed: Oct. 15, 2007

(65) Prior Publication Data

US 2008/0094286 A1 Apr. 24, 2008

(30) Foreign Application Priority Data

Oct. 16, 2006 (FR) ..... 06 54288

(51) Int. Cl.
*H01Q 21/26* (2006.01)
*H01Q 1/42* (2006.01)

(52) U.S. Cl. ..... 343/797; 343/789; 343/793

(58) Field of Classification Search ..... 343/789, 343/793, 797

See application file for complete search history.

(56) References Cited

U.S. PATENT DOCUMENTS 6,023,244 A 2/2000 Snygg et al.
6,239,764 B1 * 5/2001 Timofeev et al. ..... 343/795

FOREIGN PATENT DOCUMENTS

GB 2338346 A 12/1999

OTHER PUBLICATIONS

Mailloux R J: "Reduction of Mutual Coupling Using Perfectly Conducting Fences" IEEE Transactions on Antennas and Progagation, IEEE Service Center, Piscataway, NJ, US, vol. 19, No. 2, Mar. 1971, pp. 166-173, XP002094413.

* cited by examiner

*Primary Examiner*—Trinh V Dinh
(74) *Attorney, Agent, or Firm*—Fay Sharpe LLP

(57) ABSTRACT

The present invention provides an antenna comprising at least two arrays comprising respective pluralities of radiating elements in alignment, disposed in parallel planes, and metal screens interposed between the arrays, the antenna being characterized in that each metal screen comprises a bottom portion facing non-radiating portions of the radiating elements and comprising respective plane sheets disposed in planes parallel to the planes of the arrays, and top portions facing the radiating portions of the radiating elements and comprising panels, each forming an angle with the planes of the bottom portions. Preferably, each panel is oriented in alternation in one direction and in another direction on either side of the plane of the bottom portion. Advantageously, each panel comprises two wings connected to a central zone attached to the bottom portion of the screen.

20 Claims, 3 Drawing Sheets

DECOUPLING ARRAYS OF RADIATING ELEMENTS OF AN ANTENNA

The present invention relates to a telecommunications antenna as used in particular for cellular telephony, such as, for example, an adaptive array system (AAS) for the WiMax application (Worldwide Interoperability for Microwave Access).

An antenna of this type is made up of closely-spaced arrays of radiating elements obtained by the printed circuit technique. Such an antenna is made up of parallel arrays of dipoles placed in a housing that acts as a reflector. These antennas, often referred to as "patch" antennas, are presently in widespread use because of their very small size, of their manufacturing technology that is extremely simple, and of their cost that is moderate since they are mass-produced.

Nevertheless, such antennas present difficulties in manufacture because of conflicts that exist between different design criteria. In particular, the mutual coupling that can occur between individual radiating elements when they are close together, even though it can improve the performance of the antenna, nevertheless also presents certain negative effects, such as distorting the spectrum of the antenna or modifying the input impedance of the elements at a given frequency. It is therefore appropriate to limit such coupling without significantly increasing the weight or the size of the antenna.

In order to preserve uniform radiation, it is necessary to maintain good quality decoupling between the arrays of dipoles. Usually, the arrays of dipoles are generally isolated from one another by simple screen-forming metal walls. In order to obtain better decoupling, one solution is to increase the height of the screen so as to block electromagnetic transmission between the elements. However, when the walls are very close together, the radiating elements become confined in a small space by the screens on which multiple reflections occur, thereby reducing bandwidth. The performance of the antenna, and in particular its standing wave ratio (SWR), is thus degraded which leads to a mismatch between the input impedance of the antenna and the impedance of the transmitter (when transmission is involved). It is associated with the modulus of the reflection coefficient of the antenna.

To solve this problem, proposals have been made to place radiating elements side by side on a reflector, for example. A conductive metal line placed in the same plane as the elements and connected to ground and to the reflector surrounds these radiating elements. The radiating elements and the metal line can be made in particular by etching a layer of copper that covers a dielectric layer.

That embodiment is applicable only to elements that are contained completely within a plane parallel to that of the reflector. That solution is not applicable to radiating elements that occupy a plane perpendicular to the reflector, as applies to dipoles. The mechanical structure to be implemented under such circumstances is complex and onerous.

An object of the present invention is to eliminate the drawbacks of the prior art, and in particular to minimize the reflections that exist between the metal walls and the radiating elements, while conserving a high level of decoupling.

The present invention provides an antenna comprising at least two arrays comprising respective pluralities of radiating elements in alignment, disposed in parallel planes, and metal screens interposed between the arrays, the antenna being characterized in that each metal screen comprises a bottom portion facing non-radiating portions of the radiating elements and comprising respective plane sheets disposed in planes parallel to the planes of the arrays, and top portions facing the radiating portions of the radiating elements and comprising panels, each forming an angle with the planes of the bottom portions.

Advantageously, this angle is no greater than 45°, and preferably lies in the range 25° to 45° so as to deflect reflections, thus preventing them from reaching the dipoles.

The total length of a panel preferably lies in the range $\lambda/2$ to $\lambda/4$, where $\lambda$ is the wavelength of the center frequency of antenna operation.

Each panel is oriented in alternation in one direction and in the other, on either side of the plane of the bottom portion.

In a preferred embodiment of the invention, each panel comprises two wings connected to a central zone attached to the bottom portion of the screen.

Preferably, the central zones of two panels oriented in the same direction are separated by a distance lying in the range $0.7\lambda$to $0.9\lambda$.

Preferably, each wing has a height lying in the range $\lambda/7$ to $\lambda/11$.

Also preferably, each wing has a length lying in the range $\lambda/7$ to $\lambda/11$.

The present invention also provides a method of manufacturing an antenna comprising at least two arrays of radiating elements in alignment disposed in parallel planes, and metal screens interposed between the arrays comprising a bottom portion facing non-radiating portions of the radiating elements and comprising respective plane sheets disposed in planes parallel to the planes of the arrays, and top portions facing the radiating portions of the radiating elements and comprising panels, each forming an angle with the planes of the bottom portions. According to the invention, the method of making a screen comprises the following steps in particular:

- cutting at least two spaced-apart vertical slots in a fraction of the height of a plane plate;
- extending the slots horizontally towards each other in incomplete manner so as to retain a central zone attached to the non-cut portion of the plate and form wings on either side of the central zone; and
- folding the resulting wings on either side of the central zone in alternation in one direction and in the other direction.

Other characteristics and advantages of the present invention appear on reading the following description of an embodiment, given naturally by way of non-limiting illustration, and from the accompanying drawings, in which.

Figure 1:
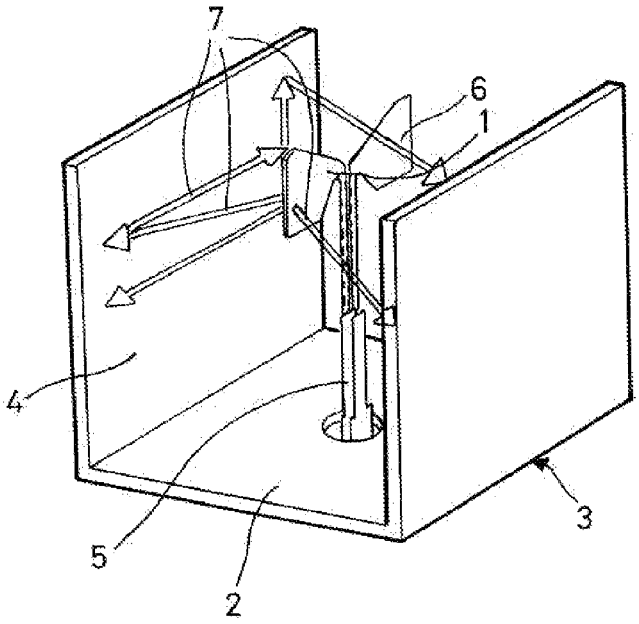
FIG. 1 is a diagrammatic view of a radiating element in a confined environment.

FIG. 1 shows a single dipole 1 secured to the bottom 2 of an antenna housing 3 and surrounded by metal screens 4. The dipole is made up of a non-radiating bottom portion 5 and a radiating top portion 6. Arrows 7 represent multiple reflections that occur on the screens 4 because of their proximity.

Figure 2:
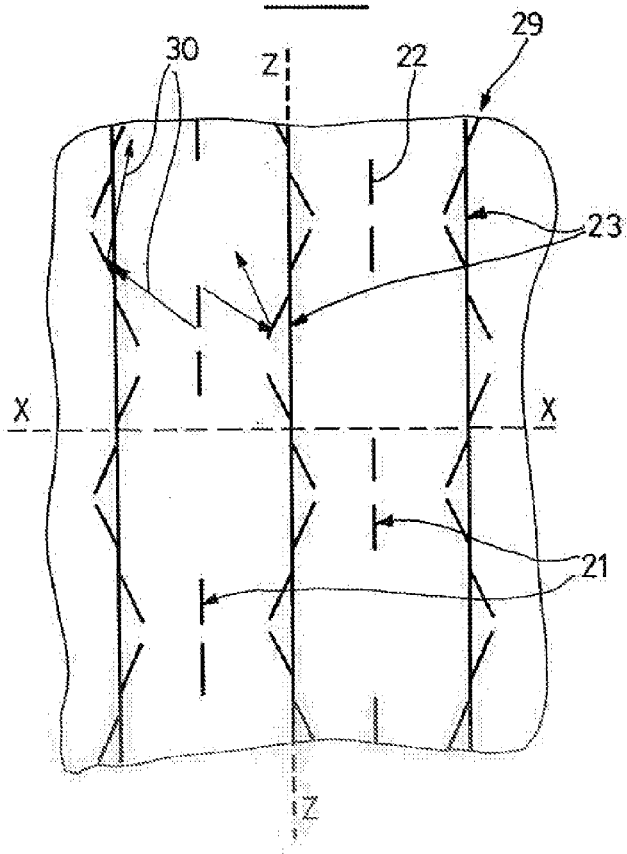
FIG. 2 is a diagrammatic plan view of a portion of the antenna of the invention.
Figure 3:
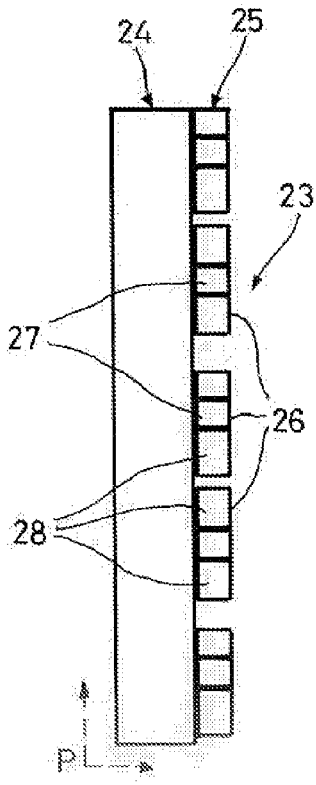
FIG. 3 is a diagrammatic side view of a screen of the FIG. 2 antenna.

A portion of an antenna of the present invention is shown diagrammatically in FIG. 2. The antenna comprises two arrays 21 forming parallel rows, made up of individual radiating elements 22. In order to reduce coupling, the arrays 21 are implanted in such a manner that the radiating elements 22 are offset relative to one another. The arrays 21 are separated by screens 23 which are parallel thereto along the longitudinal axis Z-Z of the antenna. FIG. 3 is a side view of a screen 23 looking in the transverse direction X-X of the antenna. The bottom portion 24 of the screen 23 is constituted by a plane metal sheet of height that is of the same order as the height of the non-radiating bottom portion of the individual radiating elements 22. The screen 23 also has a high portion 25 made up of panels 26 following one another in the longitudinal direction Z-Z. Each panel 26 is made up of a central zone 27 extending the bottom portion, and lying between two wings 28. The panels 26 are inclined so as to make an angle with the longitudinal axis Z-Z of the antenna, alternating in one direction and in the opposite direction relative to the axis Z-Z, thus forming a substantially zigzag line 29. Contiguous screens 23 are installed in such a manner that the concave and convex direction changes of the zigzag line 29 correspond so as to form a deflector around each radiating element 22 as represented by arrows 30 for the purpose of deflecting reflections and thus preventing them from returning to the radiating elements 22.

Figure 4:
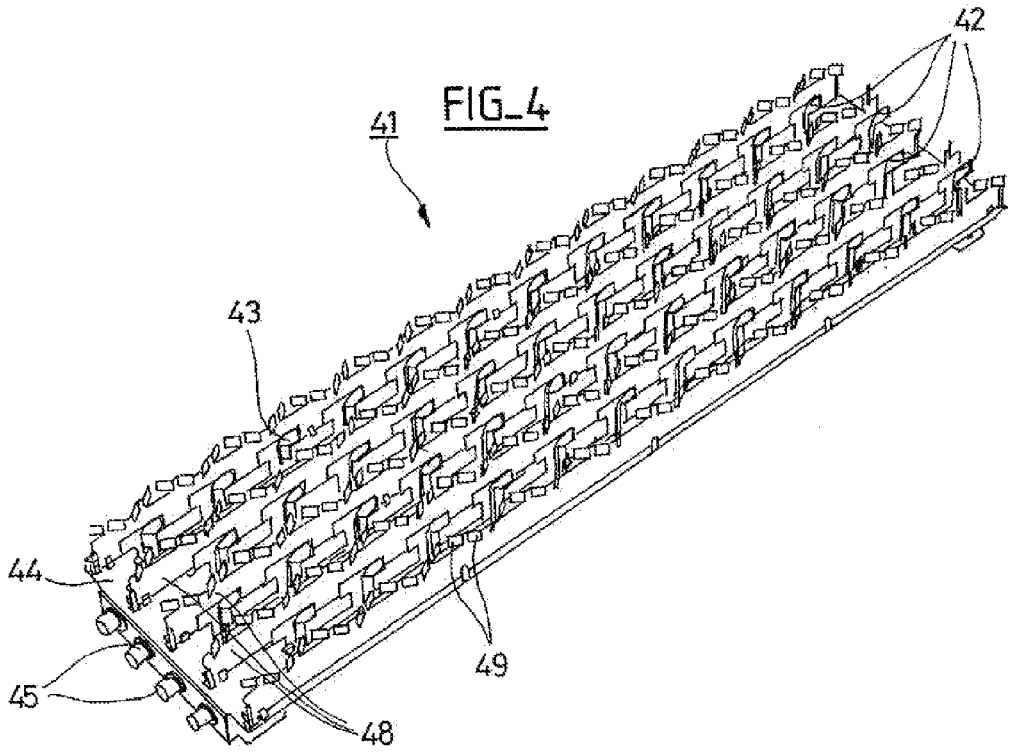
FIG. 4 is a perspective view of an embodiment of an antenna of the invention.
Figure 5:
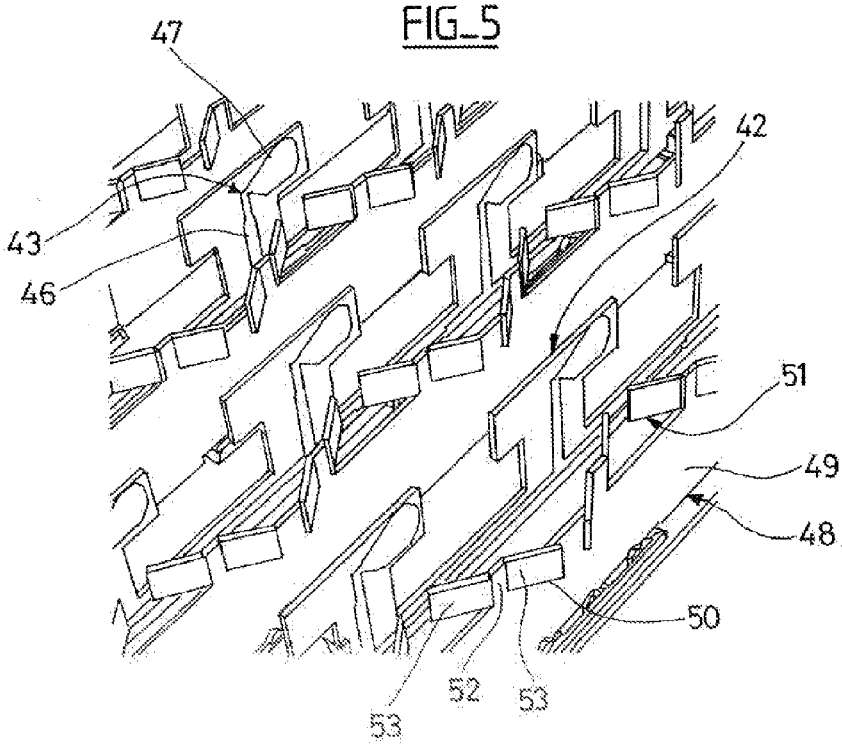
FIG. 5 is a detailed view of a portion of the FIG. 4 antenna.

In the embodiment shown in FIGS. 4 and 5, there can be seen an antenna 41 of the invention comprising four arrays 42 of individual radiating elements or dipoles 43 in alignment, forming parallel plane rows disposed perpendicularly to the base 44 of the antenna 41 on which they are secured. The dipoles 43 are made on a printed circuit. For reasons of radio-frequency performance, the distance between the arrays 42 is half a wavelength λ, where λ is the wavelength at the center frequency of antenna operation. In order to reduce coupling, the arrays 42 are implanted so that the dipoles 43 are offset relative to one another by one half-wavelength. The arrays 42 are secured to the base 44 of the antenna 41 that has four inlet connectors 45 each corresponding to a respective one of the four arrays 42 of radiating elements 43 as shown. Each dipole 43 has a non-radiating bottom portion 46 surmounted by a radiating top portion 47. Between the arrays 42, there are placed parallel metal screens 48 presenting total height of substantially the same order as the height of the arrays 42. Each screen 48 has a plane bottom portion 49 and a top portion 50 presenting panels 51 extending in a plane different from that of the plane bottom portion 49. The plane of the bottom portion 49 is also the mean plane P-P of the screen 48. Each panel 51 has a central zone 52 extending the bottom portion 49 and wings 53 cut out on either side of the central zone 52.

Figure 6:
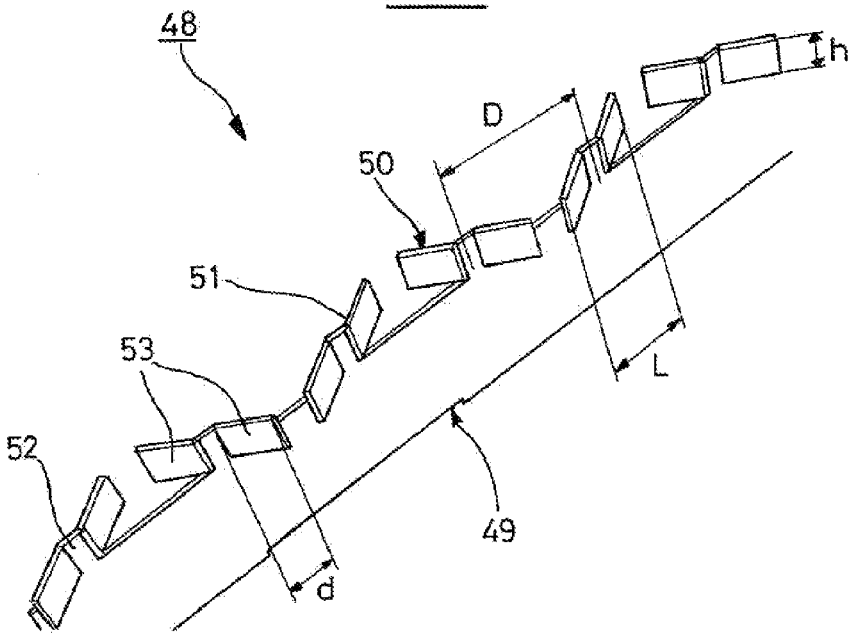
FIG. 6 is a fragmentary perspective view of a screen of the FIG. 4 antenna.
Figure 7:
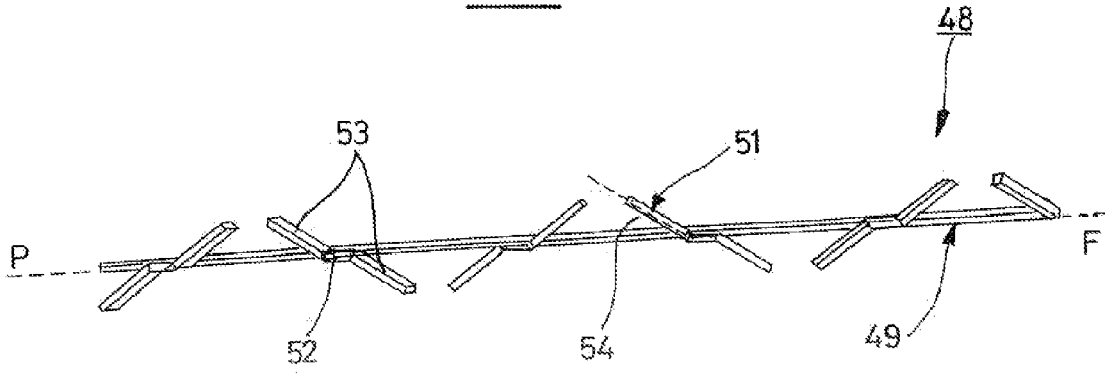
FIG. 7 is a fragmentary plan view of a screen of the FIG. 4 antenna.

A screen 48 of the invention is shown in an enlarged view in FIGS. 6 and 7. The bottom portion 49 is of a height that corresponds to the height of the non-radiating portions 46 of the facing dipoles 43. The top portion 50 extends the bottom portion 49 and faces the radiating portions 47 of the dipoles 43. The top portion 50 presents cuts in the form of regularly-spaced vertical slots that are extended on either side by incomplete horizontal cuts leaving between each pair of slots a central zone 52 that remains attached to the bottom portion 49. On either side of each central zone 52 there are two wings 53, folded towards opposite sides of the mean plane P-P of the screen 48 containing the central zone 52, in such a manner as to form an angle 54 with the mean plane P-P lying in the range 25° to 45°. The total length L of a panel 51 lies in the range λ/2 to λ/4. Adjacent wings 53 connected to different central zones 52 are folded symmetrically to the same side, such that two successive panels 51 are both oriented in respective different directions symmetrically relative to the mean plane P-P of the screen 48. The distance D between two central zones 52 included in panels 51 that are oriented in the same direction lies in the range 0.7λ and 0.9λ. In the embodiment shown, the wings 53 are preferably of a height h lying in the range λ/7 and λ/11, and of a length d lying in the range λ/7 and λ/11.

The invention claimed is:

1. An antenna comprising at least two arrays of radiating elements disposed in parallel planes, each radiating element comprising a non-radiating bottom portion and a radiating top portion, and a metal screen interposed in parallel relation between each combination of adjacent arrays of radiating elements, in which each metal screen comprises a plane bottom portion facing the non-radiating bottom portions of the radiating elements of the corresponding adjacent arrays and a high portion facing the radiating top portions of the radiating elements of the corresponding adjacent arrays, the high portion comprising a plurality of spaced panels, each panel at least partially attached to the plane bottom portion and forming an angle in relation to the plane bottom portion of the corresponding metal screen.

2. An antenna according to claim 1, in which the angle is not greater than 45°.

3. An antenna according to claim 2, in which the angle lies in the range 25° to 45°.

4. An antenna according to claim 1, in which the total length of the panel lies in the range λ/2 to λ/4.

5. An antenna according to claim 1, in which successive panels on each metal screen are oriented in alternation in one direction and in another direction in relation to the plane bottom portion of the corresponding metal screen.

6. An antenna according to claim 1, in which each panel comprises two wings connected to a central zone attached to the plane bottom portion of the corresponding metal screen.

7. An antenna according to claim 6, in which mid-points on the central zones of successive panels are spaced apart by a distance lying in the range 0.7λ and 0.9λ.

8. An antenna according to claim 6, in which each wing has a height lying in the range λ/7 to λ/11.

9. An antenna according to claim 6, in which each wing has a length lying in the range λ/7 to λ/11.

10. A method of fabricating an antenna comprising at least two arrays of radiating elements disposed in parallel planes, each radiating element comprising a non-radiating bottom portion and a radiating top portion, and a metal screen interposed in parallel relation between each combination of adjacent arrays of radiating elements, each metal screen comprising a plane bottom portion facing the non-radiating bottom portions of the radiating elements of the corresponding adjacent arrays and a high portion facing the radiating top portions of the radiating elements of the corresponding adjacent arrays, the high portion comprising a plurality of spaced panels, each panel at least partially attached to the plane bottom portion and forming an angle in relation to the plane bottom portion of the corresponding metal screen, in which the making of a metal screen comprises the following steps:

cutting at least two spaced-apart vertical slots in a fraction of the height of a plane plate;

extending the slots horizontally towards each other in incomplete manner so as to retain a central zone attached to the non-cut portion of the plate and form wings on either side of the central zone; and folding the resulting wings on either side of the central zone in alternation in one direction and in the other direction to form an angle in relation to the non-cut portion of the plane plate.

11. The method set forth in claim 10 wherein the angle is not greater than 45°.

12. The method set forth in claim 10 wherein the total length of the central zone and wings on either side of the central zone is in the range λ/2 to λ/4.

13. The method set forth in claim 10 wherein successive central zones and wings on either side of the corresponding central zone on the plane plate are oriented in alternation in one direction and in another direction in relation to the non-cut portion of the plane plate.

14. The method set forth in claim 10 wherein mid-points on successive central zones are spaced apart by a distance in the range 0.7λ and 0.9λ.

15. The method set forth in claim 10 wherein the wings are a height in the range λ/7 to λ/11.

16. The method set forth in claim 10 wherein the wings are a length in the range λ/7 to λ/11.

17. An antenna, comprising:

at least two arrays of radiating elements disposed in parallel relation to each other, each radiating element comprising:

a non-radiating bottom portion; and a radiating top portion; and;

a metal screen disposed in parallel relation between each combination of adjacent arrays of radiating elements, the metal screen comprising:

a plane bottom portion facing the non-radiating bottom portions of the radiating elements of the corresponding adjacent arrays; and a high portion facing the radiating top portions of the radiating elements of the corresponding adjacent arrays, the high portion comprising:

a plurality of spaced panels, each panel at least partially attached to the plane bottom portion and comprising:

a central zone attached to the plane bottom portion of the corresponding metal screen; and two wings connected to the central zone and forming an angle in relation to the plane bottom portion of the corresponding metal screen.

18. The antenna set forth in claim 17 wherein mid-points on the central zones of successive panels are spaced apart by a distance lying in the range 0.7λ and 0.9λ.

19. The antenna set forth in claim 17 wherein each wing has a height in the range λ/7 to λ/11.

20. The antenna set forth in claim 17 wherein each wing has a length in the range λ/7 to λ/11.

* * * * *